US012286596B2

(12) United States Patent
Urade et al.

(10) Patent No.: US 12,286,596 B2
(45) Date of Patent: Apr. 29, 2025

(54) FLUIDIZED BED DEVOLATILIZATION AND CRACKING OF SOLID REFINERY RESIDUE

(71) Applicant: SHELL OIL COMPANY, Houston, TX (US)

(72) Inventors: Vikrant Nanasaheb Urade, Bangalore North (IN); Rajeev Narayan, Karnataka (IN); Ganesh Chintakunta, Karnataka (IN); Harshavardhan Jayant Choudhari, Karnataka (IN); Dhairya Dilip Mehta, Bangalore (IN); Ashwin Kumar Nagarajan, Bangalore North (IN)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/637,209

(22) PCT Filed: Sep. 1, 2020

(86) PCT No.: PCT/EP2020/074316
§ 371 (c)(1),
(2) Date: Feb. 22, 2022

(87) PCT Pub. No.: WO2021/043753
PCT Pub. Date: Mar. 11, 2021

(65) Prior Publication Data

US 2022/0298437 A1 Sep. 22, 2022

(30) Foreign Application Priority Data

Sep. 6, 2019 (IN) ..... 201941035903

(51) Int. Cl.

| | |
|---|---|
| ***C10G 69/06*** | (2006.01) |
| ***C10B 49/10*** | (2006.01) |
| ***C10B 49/22*** | (2006.01) |
| ***C10B 55/00*** | (2006.01) |

(Continued)

(52) U.S. Cl.
CPC ..... *C10G 69/06* (2013.01); *C10B 49/10* (2013.01); *C10B 49/22* (2013.01); *C10B 55/00* (2013.01);

(Continued)

(58) Field of Classification Search
CPC ..... C10G 69/06; C10G 9/32; C10G 65/12; C10B 49/10; C10B 49/22; C10B 55/00; C10B 57/04; C10B 55/10; C10B 57/045
See application file for complete search history.

(56) References Cited

U.S. PATENT DOCUMENTS

| | | | | |
|---|---|---|---|---|
| 5,952,539 | A | 9/1999 | Seimandi et al. | |
| 2012/0118791 | A1* | 5/2012 | Cash | C10G 65/02 208/57 |

(Continued)

FOREIGN PATENT DOCUMENTS

| | | | |
|---|---|---|---|
| CN | 108251136 | A | 7/2018 |
| KR | 20110050098 | A | 5/2011 |
| WO | 9424228 | A1 | 10/1994 |

OTHER PUBLICATIONS

International Search Report and Written Opinion received for PCT Patent Application No. PCT/EP2020/074316, mailed on Jan. 19, 2021, 14 pages.

*Primary Examiner* — Renee Robinson
(74) *Attorney, Agent, or Firm* — SHELL USA, INC.

(57) ABSTRACT

Implementations of the disclosed subject matter provide a process for upgrading refinery residue feedstock. Step a) may include introducing the refinery residue feedstock into a fluidized bed reactor as a solid. In step b), the refinery residue feedstock may be heated to a devolatilizing and thermal cracking temperature in the fluidized bed reactor to produce a product stream comprising gaseous hydrocarbons and solid coke. The gaseous hydrocarbons may be subjected to catalytic hydroprocessing, in step c), in the presence of (Continued)

molecular hydrogen to increase the hydrogen to carbon ratio and lower the average molecular weight of the gaseous hydrocarbons. In step d), the gaseous hydrocarbons may be separated from the solid coke. In step e), the gaseous hydrocarbons from step d) may be subjected to further processing to produce at least one of: C1-C3 hydrocarbons, liquefied petroleum gas, naphtha range hydrocarbons, and middle distillate range hydrocarbons.

9 Claims, 6 Drawing Sheets

(51) Int. Cl.
*C10B 57/04* (2006.01)
*C10B 57/18* (2006.01)
*C10G 9/32* (2006.01)

(52) U.S. Cl.
CPC ..... *C10B 57/04* (2013.01); *C10B 57/18* (2013.01); *C10G 9/32* (2013.01); *C10G 2300/4006* (2013.01); *C10G 2300/4012* (2013.01); *C10G 2300/4018* (2013.01)

(56) References Cited

U.S. PATENT DOCUMENTS

| | | | | |
|---|---|---|---|---|
| 2012/0234726 | A1* | 9/2012 | Morel | C10G 67/02 208/49 |
| 2014/0197069 | A1 | 7/2014 | Mukheerjee et al. | |
| 2017/0145320 | A1* | 5/2017 | Li | C10G 47/02 |

* cited by examiner

FLUIDIZED BED DEVOLATILIZATION AND CRACKING OF SOLID REFINERY RESIDUE

CROSS REFERENCE TO RELATED APPLICATIONS

This is a National stage application of International application No PCT/EP2020/074316, filed Sep. 1, 2020, which claims priority of Indian Application No. 201941035903, filed Sep. 6, 2019 which is incorporated herein by reference in its entirety.

TECHNICAL FIELD OF THE INVENTION

The present invention relates to a process for upgrading solid refinery residue. More specifically the present invention relates to a process for the conversion of solid refinery residue feedstock into higher valued products, namely liquid, gaseous hydrocarbons, and coke.

BACKGROUND

A number of schemes for the upgrading 'bottom of the barrel' residues (residual hydrocarbonaceous feedstocks) in refinery processes are commercially available. Of these, delayed coking and visbreaking are considered 'carbon rejection' processes, whereas residue hydrotreating and hydrocracking are considered 'hydrogen addition' processes. Solvent de-asphalting can be used as feed preparation unit for either of these types of residue upgrading processes. Visbreaking technologies are relatively low cost but generally result in low distillate yields compared to using a delayed coker. Ebullated bed and slurry hydrocracking are also known hydroprocessing technologies generating higher yields but at greater cost.

It is important for refinery processes to extract maximum value from the crude input by achieving a balance between conversion and cost. As such, the conversion of all possible streams to valuable products is an on-going challenge.

Therefore, it would be advantageous to provide a process for upgrading solid refinery residue feedstock in order to extract valuable components and to make the overall refining process more economical than processes disclosed previously in the industry. Examples of solid refinery residue are asphalt obtained from a solvent de-asphalting unit, vacuum residue, petroleum coke with significant volatile hydrocarbon material, etc.

BRIEF SUMMARY

According to an embodiment of the disclosed subject matter, a process for upgrading refinery residue feedstock may include step a) introducing the refinery residue feedstock into a fluidized bed reactor as a solid. In step b), the refinery residue feedstock may be heated to a devolatilizing and thermal cracking temperature in the fluidized bed reactor to produce a product stream comprising: gaseous hydrocarbons and solid coke. The gaseous hydrocarbons may be subjected to catalytic hydroprocessing, in step c), in the presence of molecular hydrogen to increase the hydrogen to carbon ratio and lower the average molecular weight of the gaseous hydrocarbons. In step d), the gaseous hydrocarbons may be separated from the solid coke to produce a gaseous product stream and a solid coke product stream. In step e), the gaseous hydrocarbons from step d) may be subjected to further processing to produce at least one of: C1-C3 hydrocarbons, liquefied petroleum gas, naphtha range hydrocarbons, and middle distillate range hydrocarbons.

According to an implementation of the disclosed subject matter, a process for upgrading solid refinery residue feedstock may include step a) introducing the refinery residue feedstock into a fluidized bed reactor as a solid. In step b), the refinery residue feedstock may be heated to a devolatilizing and thermal cracking temperature in the fluidized bed reactor to produce a product stream comprising gaseous hydrocarbons and solid coke. In step c), the gaseous hydrocarbons may be separated from the solid coke in step b) to produce a gaseous product stream and a solid coke product stream. In step d), at least part of the gaseous hydrocarbons from step c) may be combusted to generate energy.

Implementations of the disclosed subject matter provide an improved process for upgrading refinery residue feedstock. The disclosed subject matter allows for extraction of valuable components and makes the overall refining process more economical than previously disclosed industry processes. Additional features, advantages, and embodiments of the disclosed subject matter may be set forth or apparent from consideration of the following detailed description, drawings, and claims. Moreover, it is to be understood that both the foregoing summary and the following detailed description are examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

In general, asphalt can be obtained from a solvent de-asphalting unit that processes straight run residue from a crude distillation unit or cracked residue from a visbreaker in the refinery process. Typically, this asphalt can then be used as feed for a gasifier unit or as feed for a power plant. The most suitable option available for asphalt upgrading today is the gasifier. However, the gasifier is a capex-intensive unit and often has reliability issues, leading to significant downtime. The gasifier produces high-value products but also needs significant downstream processing to realize the value of gasification. Additionally, the gasification process is a capex-intensive process and often has reliability issues leading to poor availability. In contrast, the present invention described herein is a simpler process with lower capex as compared to a gasifier.

Additionally, power generation from asphalt is discouraged because of high emissions of environmentally harmful gases during combustion. Power generation from asphalt requires combustion of the asphalt to produce high-pressure steam which is used for generating power. The asphalt which contains high levels of sulfur and other impurities produces high amounts of pollutants along with carbon dioxide emissions. In contrast, the present invention described herein provides for the vapor phase product from the fluidized bed to be further processed in a hydroconversion reactor, and the products may be treated, and impurities may be removed.

Another known technique is that asphalt can be pelletized and sold in the market or blended into a bitumen or fuel oil product. However, selling asphalt as pellets or blending into bitumen or fuel oil is relatively uneconomical in terms of value realization from the asphalt as these products do not yield a relatively high price.

Figure 1:
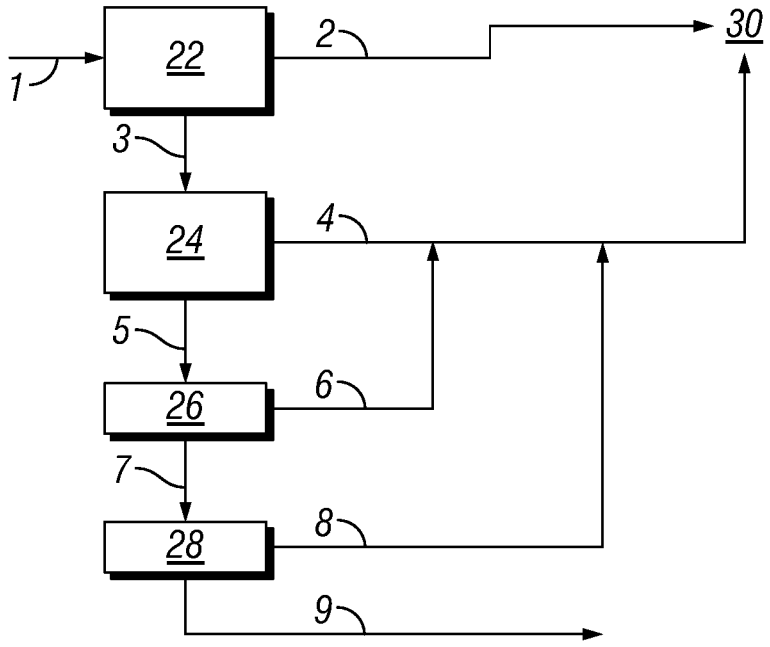
FIG. 1 (Prior Art)
FIG. 1 shows a comparative example of a known refinery process.

FIG. 1 shows a comparative process line up as previously disclosed in the refining industry. As shown in FIG. 1, crude oil feedstock (1) is processed in crude distillation unit (CDU) (22) to produce distillates (2) and long residue products (3). Long residue products (3) from CDU (22) are further processed in vacuum distillation unit (24) to produce distillates (4) and vacuum residue products (5). Vacuum residue products (5) are subjected to thermal cracking and separation in visbreaking unit (VBU) (26) to produce gas oil and lighter products (6) and vacuum flasher cracked residue (7). The vacuum flasher cracked residue product (7) is deasphalted in a solvent deasphalting unit (SDA) (28) to obtain a deasphalted product (8) and a solid asphalt product (9). As shown in FIG. 1, distillates (2) (4) and gas oil and lighter products (6), may be combined to produce gas and distillates (such as naphtha, gasoil, vacuum gasoil, etc.).

Alternatively, although not shown in FIG. 1, vacuum residue products (5) may be deasphalted in a solvent deasphalting unit (SDA) (28) to obtain a deasphalted product (8) and a solid asphalt product (9). In this process line-up, visbreaking unit (VBU) (26) and resulting streams (6) and (7) may be omitted.

Asphalt, for example the solid asphalt product (9) in FIG. 1 above, currently has four main applications: (i) as a source of heat and chemicals, e.g., by gasification and using the resultant gas for producing various chemicals or use its heat value (ii) as a component of bitumen (iii) as a blend component for fuel oil, including marine fuel oil and (iv) for power generation e.g. in a fluidized bed combustor. It is highly desirable to realize conversion of asphalt into higher valued products such as gas, distillate and coke which is free of volatile carbonaceous material (VCM), to improve the economics of a petroleum refining operation.

As such, and as shown in comparative FIG. 1, there is a need for an improved process for upgrading solid refinery residue feedstock in order to extract valuable components and to make the overall refining process more economical than previously disclosed industry processes.

The present invention requires relatively lower capex and is a more environmentally friendly process for asphalt valorization as compared to competing processes described above (e.g., gasification, power generation, and pelletization). High-value liquid and gaseous products are formed at the reactor outlet which can be separated in existing separation assets available within the refinery.

The presently disclosed subject matter is a process for upgrading solid refinery residue. Specifically, the invention is a process for the conversion of the solid refinery residue feedstock into higher valued products, namely gaseous and liquid hydrocarbons and coke. As mentioned above, the solid refinery residue can be asphalt obtained from a solvent deasphalting unit which processes either straight run residue obtained from atmospheric and/or vacuum distillation of crude or cracked residue obtained from visbreaking. Occasionally, the solvent de-asphalting unit may also co-process other refinery residue streams like slurry oil from a fluidized catalytic cracking unit, hydrowax from a hydrocracking unit, etc. Solid refinery residue feedstock can also be the vacuum residue obtained directly from vacuum distillation of crude or by vacuum distillation or vacuum flashing of cracked residue. The disclosed process can also be applied for other solid refinery residues such as coke from a gasifier, residue from an ethylene cracker, and petroleum coke obtained from a delayed coker unit.

The present invention provides a process for subjecting the solid feedstock to heating, devolatilizing and thermally cracking it to produce lighter hydrocarbons in an atmosphere containing molecular hydrogen in a mix of gases or flue gas. A catalytically inert heat transfer material may be used in a fluidized bed. Further, the process may operate under conditions where the lighter hydrocarbons and other products of devolatilization and thermal cracking reaction, except the coke co-product, remain in the gaseous phase. Thus, the fluidized bed may comprise of solid and gaseous species, where the solid species (for example, catalytically inert heat transfer material and coke) may be fluidized by the gaseous species, with solid species forming the emulsion phase of a bubbling fluidized bed reactor, and gaseous species forming the bubble phase.

Figure 2:
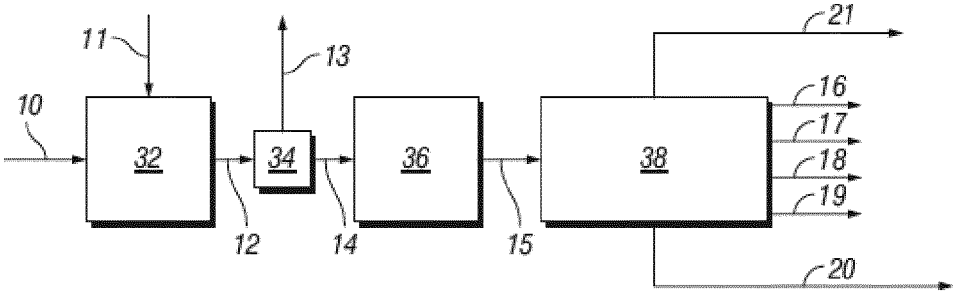
FIG. 2 shows an example process according to an implementation of the disclosed subject matter.

Referring to FIG. 2, the presently disclosed subject matter can be clearly understood. As shown in FIG. 2, a process for upgrading refinery residue feedstock may include introducing the refinery residue feedstock (10) into a fluidized bed reactor (32) as a solid in step a). The refinery residue feedstock may be heated to a devolatilizing and thermal cracking temperature in the fluidized bed reactor (32) in step b) to produce a product stream (12) comprising gaseous hydrocarbons and solid coke.

In step c), the gaseous hydrocarbons may be subjected to catalytic hydroprocessing in the presence of molecular hydrogen to increase the hydrogen to carbon ratio and lower the average molecular weight of the gaseous hydrocarbons. There are various options for where in process step c) is carried out. In one embodiment, and as shown in FIG. 2, the catalytic hydroprocessing of step c) may be carried out in fluidized bed reactor (32) (e.g., a bubbling fluidized bed reactor), in the presence of molecular hydrogen (11) to increase the hydrogen to carbon ratio and lower the average molecular weight of the gaseous hydrocarbons. In this embodiment, reactor (36) may not be present in the process line up. In another embodiment, and as shown in FIG. 2, at least a portion of the catalytic hydroprocessing of step c) may be carried out in fluidized bed reactor (32) (e.g., a bubbling fluidized bed reactor), in the presence of molecular hydrogen (11). In this embodiment, product stream (12) comprising gaseous hydrocarbons and solid coke may be fed to a separator (34). In step d), the gaseous hydrocarbons may be separated in the separator (34) from the solid coke to produce a gaseous product stream (14) and a solid coke product stream (13). In this embodiment, the gaseous product stream (14) may be fed to a fixed bed reactor (36) in which the remaining portion of the catalytic hydroprocessing of step c) may be carried out to produce gaseous hydrocarbons (15).

In step e), the gaseous hydrocarbons from step d) may be subjected to further processing to produce at least one of: C1-C3 hydrocarbons, liquefied petroleum gas, naphtha range hydrocarbons, and middle distillate range hydrocarbons. As shown in FIG. 2, in step e), the hydrocarbons (15)

may be subjected to further processing in work up section (38) to produce at least one of: C1-C3 hydrocarbons, liquefied petroleum gas, naphtha range hydrocarbons, and middle distillate range hydrocarbons. The work up section (38) may fractionate the effluents of fixed bed reactor (36) or the effluents of fluidized bed reactor (32) (in the embodiment in which no fixed bed reactor (36) is present) to produce liquid products liquefied petroleum gas (17), naphtha (18), middle distillates (19) and unconverted volatile carbonaceous material (20). Gaseous streams may be treated to remove $H_2S$ and $NH_3$ and separated into two gaseous streams, one stream rich in hydrogen (16) and another lean gas stream (21).

As optionally shown in FIG. 2, and according to yet another embodiment, the fluidized bed reactor (32) in step b) may be a bubbling fluidized bed reactor comprising a catalytically substantially inert heat transfer material. In this embodiment, the catalytic hydroprocessing of step c) may be carried out in a fixed bed reactor (36) after separation step d) in separator (34).

In an embodiment of the presently disclosed subject matter, a process for upgrading refinery residue feedstock may include step a) introducing the refinery residue feedstock into a fluidized bed reactor as a solid. While the refinery residue feedstock is being introduced to the fluidized bed reactor, melting and softening of the solid refinery residue feedstock is avoided while feeding to the reactor.

The solid refinery residue feedstock may be introduced into the reactor by any suitable feeding mechanism. An example of suitable feeding mechanism is a double-screw feeder system, comprising of a slow metering screw operating at a temperature below 50 deg. C. coupled with a fast dosing screw feeding the solid feedstock into the fluidized bed reactor without causing any melting or undesirable reactions within the screw itself.

Optionally, the screw or screw housing may be cooled and purged with cold gas to maintain solid feedstock temperature below its melting point until it enters the fluidized bed.

The process typically operates at a pressure greater than ambient pressure (1 atm). The feedstock may then be introduced across a pressure boundary using a lock hopper mechanism.

In step b), the refinery residue feedstock may be heated to a devolatilizing and thermal cracking temperature in the fluidized bed reactor to produce a product stream comprising gaseous hydrocarbons and solid coke. This may be referred to as devolatilization and thermal conversion process. These gaseous hydrocarbons may be enriched in hydrogen over carbon relative to the refinery residue feedstock. The refinery residue feedstock undergoes this thermal conversion process and at least a portion of the catalytic conversion process within the bubbling fluidized bed. This thermal conversion process results in the liberation of hydrocarbon molecules from the solid refinery residue feedstock, which are then released into the gas phase, producing a product stream comprising gaseous hydrocarbons and solid coke. In the thermal process, the vapor-phase molecules that are liberated from the refinery residue feedstock are enriched in hydrogen over carbon while the leftover solid coke is enriched in carbon over hydrogen.

In another embodiment, the fluidized bed reactor in step b) may be an entrained fluidized bed reactor comprising the solid refinery residue feedstock and the solid coke entrained in a stream of gas containing the molecular hydrogen.

In step c), the gaseous hydrocarbons may be subjected to catalytic hydroprocessing in the presence of molecular hydrogen to increase the hydrogen to carbon ratio and lower the average molecular weight of the gaseous hydrocarbons. This catalytic hydroprocessing step may be fully carried out in a fluidized bed reactor, may be partially carried out in a fluidized bed reactor and partially carried out in a separate fixed bed reactor, or may be fully carried out in a separate fixed bed reactor downstream from a fluidized bed reactor and after solid separation in step d).

In an embodiment, and as mentioned above, the fluidized bed reactor in step b) may be a bubbling fluidized bed reactor and at least a portion of the catalytic hydroprocessing in step c) may be carried out in the bubbling fluidized bed reactor. In another embodiment, the fluidized bed reactor may be a riser reactor (co-current or counter current flow of solid refinery residue feedstock and a fluidizing gas) and at least a portion of the catalytic hydroprocessing in step c) may be carried out in the riser reactor.

In an embodiment, the refinery residue feedstock may be subjected to at least a portion of the catalytic hydroprocessing in the presence of a catalyst in a bubbling fluidized bed reactor. The bubbling fluidized bed reactor may contain the catalyst vigorously set in motion within a reactor vessel by a stream of pre-heated gas containing molecular hydrogen ($H_2$). The catalytic conversion process within the bubbling fluidized bed of this embodiment comprises of a series of reactions catalyzed by the catalyst in the presence of hydrogen. These reactions may include one or more of the following reactions: hydrogenation, hydrodemetallization, hydrodesulfurization, hydrodenitrogenation, hydrodeoxygenation, and hydrocracking. Hydrogenation refers to the addition of hydrogen to a hydrocarbon molecule, increasing its hydrogen content. Hydrogenation when applied to aromatic hydrocarbon is also referred to as hydrodearomatization. Hydrodemetallization refers to the removal of metal atoms (e.g., nickel and vanadium) from the liberated gas-phase hydrocarbon molecules. Hydrodesulfurization refers to the removal of sulfur from the gas-phase hydrocarbon molecules, mainly in the form of hydrogen sulfide ($H_2S$). Hydrodenitrogenation refers to the removal of nitrogen from the liberated gas-phase hydrocarbon molecules, mainly in the form of ammonia ($NH_3$). Hydrodeoxygenation refers to the removal of oxygen from the liberated gas-phase hydrocarbon molecules, mainly in the form of water, carbon dioxide or carbon monoxide ($H_2O$, $CO_2$, or CO). Hydrocracking refers to the reaction of scission of a hydrocarbon molecule in the presence of hydrogen and a catalyst that converts the hydrocarbon molecule into smaller hydrocarbon molecules to reduce the average molecular weight of the hydrocarbon product. Collectively, these reactions may be referred to as hydroprocessing.

The gas used as fluidization medium may be a gas containing molecular hydrogen having between 10 and 100 vol % hydrogen. Examples of suitable gas streams include PSA-quality hydrogen manufactured in a hydrogen generation unit in a refinery by steam reforming of light hydrocarbons, or a fuel gas stream containing more than 50 vol % hydrogen.

In general, any catalyst composition capable of carrying out any one or more of the abovementioned reactions is suitable as the catalyst in the presently disclosed process. Below we mention some non-limiting examples of the catalyst suitable for this process.

In one embodiment of this invention, the fluidized bed reactor contains a catalyst. The catalyst may also function as a heat transfer material. The catalyst material may comprise a hydrotreating catalyst material, a hydrocracking catalyst material, a demetallization catalyst material or combinations thereof. The hydrotreating catalyst material may comprise of one or more of the metals selected from the group containing nickel, cobalt, tungsten and molybdenum, supported on a metal oxide such as alumina, silica, zirconia, amorphous silica-alumina or combinations thereof. The hydrocracking catalyst material may comprise of a solid acid catalyst containing a zeolite, amorphous silica-alumina, supported phosphoric acid or combinations thereof, in combination with a hydrotreating function containing one or more of the metals selected from the group containing nickel, cobalt, tungsten and molybdenum, supported on an metal oxide such as alumina, silica, zirconia, amorphous silica-alumina or combinations thereof.

According to an embodiment, the fluidized bed reactor may comprise at least one catalyst comprising at least one active metal selected from the group consisting of: group VB, group VIB and group VIII of the periodic table supported on metal oxide selected from: alumina, silica, titania, silica-alumina, ceria, zirconia, crystalline aluminosilicates and combinations thereof.

According to another embodiment, the fixed bed reactor may comprise at least one catalyst comprising at least one active metal selected from the group consisting of: group VB, group VIB and group VIII of the periodic table supported on metal oxide selected from: alumina, silica, titania, silica-alumina, ceria, zirconia, crystalline aluminosilicates and combinations thereof.

The catalyst compositions used in the process of the present invention comprise of one or more active metals supported on one or more metal oxides. The active metals are selected from a group comprising of cobalt, molybdenum, nickel, tungsten, ruthenium, platinum, palladium, iridium, iron. Preferably, the one or more active metals are selected from cobalt, molybdenum, nickel and tungsten.

The metals present in the catalyst compositions used in the process of the present embodiment are supported, preferably on a metal oxide support. Compositions of matter useful as supports for the catalyst include one or more of the following: alumina, silica, amorphous silica-alumina, crystalline aluminosilicates, titania, ceria, zirconia, as well as binary oxides such as silica-alumina, silica-titania and ceria-zirconia, and hydrotalcites Preferred supports include those containing metal oxides such as alumina, amorphous silica-alumina and crystalline aluminosilicates. The most preferred support is a combination of alumina, amorphous silica-alumina and a zeolite. The support may optionally contain recycled, regenerated and revitalized fines of spent hydrotreating catalysts (e.g., fines of CoMo on oxide supports, NiMo on oxide supports and fines of hydrocracking catalysts containing NiW on a mixture of oxide and zeolite support).

Total active metal loadings on the catalyst compositions are preferably in the range of from 0.02 wt % to 2 wt % for noble metals (e.g., ruthenium, platinum, palladium and iridium) and from 1 wt % to 75 wt % for non-noble metals (e.g., cobalt, molybdenum, nickel, tungsten and iron) (weight percentages are expressed as a weight percentage of total of all active metals on the calcined catalyst in their reduced (metallic) form). The rest of the catalyst composition comprises of a support or carrier material. A preferred composition of the support or carrier material contains alumina, silica, amorphous silica-alumina and a zeolite. Typically, the weight percent of alumina in the support material varies from 1 wt % to 100 wt %, the weight percent of silica in the support material varies from 1 wt % to 100 wt %, that of amorphous silica-alumina varies from 1 wt % to 100 wt % and that of the zeolite varies from 1 wt % to 75 wt %.

Optionally, additional agents may be incorporated into the catalyst composition to increase the dispersion of the active metal on the carrier. As is known to those skilled in the art, an increase in the dispersion promotes the formation of very small regions (a few nanometers in size) of the active metals, which increase the activity of the catalyst for any of the abovementioned reactions. Agents that are suitable for use in this manner include inorganic agents (one or more of phosphorous, boron and nickel) or one or more of organic agents that can interact with the precursors of active metals thereby stabilizing the small-sized domains of active metals on the carrier. Depending on the nature of agent used, it may decompose and disappear from the catalyst composition during the activation of the catalyst or during its use or remain incorporated within the catalyst composition.

The catalyst compositions used in the process of the presently disclosed process may be prepared by any suitable method known in the art. Suitable methods include, but are not limited to, co-precipitation of the active metals and the support from a solution; homogeneous deposition precipitation of the active metals on the support; pore volume impregnation of the support with a solution of the active metals; sequential and multiple pore volume impregnations of the support by a solution of the active metals, with a drying or calcination step carried out between successive pore volume impregnations; co-mulling of the support with a solution or a powder containing the active metals. Further, a combination of two or more of these methods may also be used.

Of these methods, preferable methods for obtaining higher (greater than or equal to 40 wt %) loadings of the active metal on the support include co-precipitation of the active metals and the support from a solution; sequential and multiple pore volume impregnations of the support by a solution of the active metals, with a drying or calcination step carried out between successive pore volume impregnations; co-mulling of the support with a solution or a powder containing the active metals; and combinations of two or more of these methods.

After preparation by one of these or another method, the compositions thus-formed may be suitably calcined in the presence of air or oxygen in order to obtain the catalyst composition in an oxidic phase. By the term 'oxidic state' as used herein is meant that 95% or more of the active metal atoms present are present in an oxidation state greater than zero as oxides. For example, a supported oxidic CoMo catalyst has more than 95% of the metal present either as molybdenum present in the +6 oxidation state as oxides or cobalt present in the +2 or +3 oxidation state, as oxides. Optionally, the catalyst composition prepared by any of the abovementioned methods is not subjected to a calcination at all and is simply dried to remove excess moisture. In case of such non-calcined catalyst, not all the active metal atoms are present in their higher oxidation states.

The catalyst composition is provided in a physical form that is suitable for use in a bubbling fluidized bed reactor and/or fixed bed reactor. The most preferred physical form of the catalyst is a form with sphericity of >0.90. Higher sphericity is preferred as it minimizes the attrition of the catalyst in the bubbling fluidized bed reactor, and thus the loss of the catalyst from the reactor. Catalyst particles sizes, for use in a commercial reactor in a bubbling fluidized bed reactor, are preferably in the range of from 0.1 mm to 8.0 mm, more preferably in the range of from 0.4 mm to 3.0 mm, and most preferably in the range of from 0.4 mm to 2 mm.

After the catalyst composition is provided in the bubbling fluidized bed reactor vessel and/or fixed bed reactor vessel, it may be subjected to an activation procedure before the introduction of the asphalt feedstock. Examples of suitable activation procedures include sulfidation, reduction, phosphidation, carburization and nitridation. Sulfidation is an activation procedure that converts a majority of the active metals in the catalyst composition into their sulfide forms. Sulfidation comprises of subjecting the catalyst composition to a sulfur-containing molecule at sulfiding temperatures. The sulfur-containing molecules may be present in the gas-phase, or in the catalyst composition itself, or may be present in both the media. Reduction is an activation procedure that reduces the oxidation state of a majority of the active metals in the catalyst composition to zero. Reduction comprises of subjecting the catalyst composition to a reducing gas (e.g., hydrogen containing gas) at reducing temperatures. Phosphidation is an activation procedure that converts a majority of the active metals in the catalyst composition into their phosphide forms. Phosphidation comprises of subjecting the catalyst composition to phosphorous containing molecule at phosphiding temperatures. Phosphorous-containing molecules may be present in the gas-phase, or in the catalyst composition itself, or may be present in both the media. Carburization is an activation procedure that converts a majority of the active metals in the catalyst composition into their carbide forms. Carburization is carried out by subjecting the catalyst to carbon-containing molecules at carburizing temperatures. The carbon-containing molecules may be present in the gas-phase, or present in the catalyst composition itself, or may be present in both the media. Nitridation is an activation procedure that converts a majority of the active metals in the catalyst composition into their nitride forms. Nitridation is carried out by subjecting the catalyst composition to a nitrogen-containing molecule at nitriding temperatures. The nitrogen containing molecule may be present in the gas-phase, or in the catalyst composition, or may be present in both the media. Catalyst activation may be carried out as a separate step in a sequence before the introduction of the solid refinery residue feedstock or may occur concurrently with the introduction of the solid refinery residue feedstock and its processing in the fluidized bed reactor. An example of concurrent feedstock processing and catalyst activation is sulfidation. The solid refinery residue feedstock may contain sulfur, and this feedstock sulfur may convert the catalyst into a sulfided form as the feedstock and products of its devolatilization come in contact with the catalyst.

It will be readily apparent that, although the catalyst composition provided in the bubbling fluidized bed reactor and/or fixed bed reactor will initially comprise active metals in an active state as produced by the applied activation procedure, the chemical form of the catalyst composition will undergo a change under the operating environment of the process, resulting in a change in the chemical form of the active metals on the catalyst and of the support as well. This change will involve phenomena resulting from the interaction of the catalyst with the reactant gas (hydrogen), products (hydrocarbons) and byproducts (hydrogen sulfide, ammonia, hydrocarbons et cetera) under the temperature and pressure conditions of the process.

In an embodiment, the initial chemical composition will be transformed under the conditions of the process of the invention into a composition where a portion of the active metals may be in reduced form (with an oxidation number of zero), another portion of the active metals may be in a higher oxidation state in sulfided form (forming a chemical bond with sulphur atoms present in the biomass feedstock) and yet another portion of the active metals may be in any other active state (e.g., any combination of oxidic, phosphided, carburized, nitride et cetera).

Further, the vigorous motion of the catalyst in the bubbling fluidized bed may result in attrition of the catalyst. Such attrited catalyst particles, known as catalyst fines, leave the reactor whereas predominantly unattrited catalyst remains within the bubbling fluidized bed reactor vessel in the present embodiment of the invention. Catalyst may be added to the bubbling fluidized bed reactor in order to replace catalyst lost through attrition. The catalyst added to make-up for the attrition losses may be activated using a suitable activation procedure in a separate vessel or may be activated in-situ in the bubbling fluidized bed reactor itself while the feedstock to be processed is being fed into the reactor.

After the separation of the solid coke, the gaseous stream comprising unreacted hydrogen and gaseous hydrocarbons of the bubbling fluidized bed reactor, may be cooled and processed over a fixed bed of catalyst in the gas phase. The composition of the catalyst used in the fixed bed reactor generally falls within the composition window defined in herein for the catalyst used in the fluidized bed reactor. However, the precise compositions of the fixed bed catalyst and fluidized bed catalyst in any specific embodiment of this process may not be identical. The physical form of the catalyst used in the fixed bed reactor is also generally different from that of the catalyst used in the fluidized bed reactor-typically fixed bed catalyst comprises of nominally cylindrical pellets, nominally multilobe extrudates (e.g., trilobes) or nominally spheres.

As described herein, the catalyst converts the products of devolatilization of the solid refinery residue feedstock substantially into hydrocarbons boiling in naphtha, kerosene and diesel range by removing the heteroatoms from the products of devolatilization (such as sulfur, nitrogen and metals) and at least partially saturating unsaturated functions (olefins, aromatics). In the preferred embodiment, the heat required for devolatilization is substantially provided by the exothermic heat of hydrogenation and hydrotreating reactions taking place simultaneously in the fluidized bed reactor.

Various operating conditions may be selected to maximize the efficiency of the disclosed process. For example, the operating temperature and pressure of the fluidized bed reactor may be chosen in such a way that all the products of the devolatilization and thermal conversion process, except for the solid coke product, remain in the vapor phase. The temperature and pressure of the operation of fluidized bed reactor are chosen so as to have at least 10 wt % of the initial mass of solid feedstock converted into a vapor phase in the fluidized bed reactor. More preferably, at least 30 wt % and most preferably, at least 50 wt % of the solid feedstock is converted into a vapor phase in the fluidized bed reactor.

In an embodiment of the invention, the bubbling fluidized bed reactor comprises of a catalyst, and the refinery residue feedstock to be processed undergoes a thermal conversion process and catalytic hydroprocessing in the bubbling fluidized bed reactor. The superficial gas velocity through the bubbling fluidized bed reactor is chosen so that the unattrited catalyst remains within the bubbling fluidized bed reactor, while the carbon-rich residual product of the solid feedstock conversion ("coke") is elutriated out of the reactor with the fluidizing medium.

The operating parameters of significance for the bubbling fluidized bed include the total pressure at the inlet (i.e., bottom) of the bubbling fluidized bed reactor, hydrogen partial pressure at the inlet of the reactor, average temperature of the bubbling fluidized bed, weight-average space velocity of the feedstock, stoichiometric excess of hydrogen provided, gas-phase residence time and solid (coke) residence time.

The total pressure of operation of the bubbling fluidized bed reactor varies from 0.5 barg to 100 barg, more preferably from 5 barg to 75 barg, and most preferably from 15 barg to 40 barg. The hydrogen partial pressure at the inlet (bottom) of the bubbling fluidized bed reactor varies from 0.5 barg to 100 barg, more preferably from 5 barg to 50 barg, and most preferably from 15 barg to 35 barg.

To achieve desirable thermal conversion of the asphalt feedstock, the average the devolatilizing temperature of the bubbling fluidized bed reactor must be a minimum of 250° C., more preferably between 350° C. and 600° C., most preferably between 400° C. and 550° C.

The weight-hourly space velocity, defined as kilograms of refinery residue feedstock processed per hour per kilogram of catalyst in the reactor, varies from 0.05 to 25, more preferably from 0.2 to 10, and most preferably from 0.5 to 2.5. The stoichiometric excess of hydrogen provided to the bubbling fluidized bed reactor is defined as the ratio of the total weight of molecular hydrogen ($H_2$) supplied to the bubbling fluidized bed reactor to the hydrogen chemically consumed in all the hydroprocessing reactions required to convert asphalt to the hydrocarbon product. The stoichiometric excess of hydrogen provided varies from 1.5 (i.e., 50% excess hydrogen provided) to 20, more preferably from 2 to 10, and most preferably from 2.5 to 5. Gas phase residence time is the average time spent by a pocket of gas in the bubbling fluidized bed reactor in contact with the fluidized catalyst bed. Gas phase residence time varies from 0.1 s to 100 s, more preferably from 2 s to 75 s, and most preferably from 4 s to 40 s. Solid-phase residence time is defined as the average time spent by a solid (coke) particle in the bubbling fluidized bed reactor. Solid phase residence time varies from 5 s to 500 s, more preferably from 10 s to 400 s, and most preferably from 20 s to 250 s.

As mentioned above, in one embodiment at least a portion of the catalytic hydroprocessing in step c) may be carried out in a fixed bed reactor following step d). The operating parameters of significance for the fixed bed reactor include the total pressure at the inlet of the reactor, hydrogen partial pressure at the inlet of the reactor, average temperature of the catalyst bed and weight-average space velocity of the feedstock.

The total pressure of operation of the fixed-bed reactor varies from 0.5 barg to 100 barg, more preferably from 5 barg to 75 barg, and most preferably from 15 barg to 40 barg. The hydrogen partial pressure at the inlet of the fixed-bed reactor varies from 0.5 barg to 100 barg, more preferably from 5 barg to 50 barg, and most preferably from 15 barg to 35 barg. The average temperature of the fixed-bed reactor varies from 150° C. to 600° C., more preferably between 250° C. and 400° C., most preferably between 280° C. and 360° C. The weight-hourly space velocity, defined as kilograms of refinery residue feedstock processed per hour per kilogram of catalyst in the reactor, varies from 0.05 to 25, more preferably from 0.2 to 8, and most preferably from 0.3 to 2.

In this embodiment, step c) may be carried out in a fixed bed reactor at a temperature of from 150° C. to 600° C., a total pressure of from 0.5 barg to 100 barg, and a weight-hourly space velocity of from 0.05 to 25 kilograms of refinery residue feedstock per kilogram of fixed bed catalyst per hour.

In step d), the gaseous hydrocarbons may be separated from the solid coke to produce a gaseous product stream and a solid coke product stream. In an embodiment, the gas-solid product may be subjected to a separation step to remove the solid coke product from the rest of the gaseous product stream. Any means suitable for separation of a solid from a hot gaseous stream may be employed. For example, hot gas filtration using a sintered stainless steel filter, hot gas filtration using CatTrap™ solid separation media, separation using one or more cyclones, electrostatic precipitation, wet scrubbing or a combination of any of these methods may be used to separate the solid coke from the rest of the gaseous product stream.

As mentioned above, in one embodiment, the fluidized bed reactor in step b) may be a bubbling fluidized bed reactor comprising a catalytically inert heat transfer material and the catalytic hydroprocessing in step c) may be carried out in a fixed bed reactor before or after step d). In this embodiment, a catalytically inert heat transfer material may be any inert heat transfer material that is substantially catalytically inert. In another embodiment, the fluidized bed reactor may be a rise reactor (co-current or counter current flow of solid refinery residue feedstock and a fluidizing gas) comprising a catalytically inert heat transfer material and the catalytic hydroprocessing in step c) may be carried out in a fixed bed reactor before or after step d).

In particular, the bubbling fluidized bed reactor may not contain any catalyst but may contain a catalytically inert heat transfer solid. The catalytically inert heat transfer solid is an inert material that does not have any appreciable catalytic activity, however it distributes the heat axially and radially in the reactor and transfers the heat to the feedstock (asphalt) particles to drive the thermal processes. In this embodiment, only the thermal conversion process takes place in the bubbling fluidized bed reactor. Examples of catalytically inert heat transfer solids include dense, low surface area metal oxide particles such as silica, alumina, titanium oxide, sand, gravel, fly ash, and optionally a desulfurization material. In an embodiment, the catalytically inert heat transfer solid is a metal oxide material without any active metal, having a total surface area of 20 $m^2/g$ or less, and more preferably having a total surface area of 10 $m^2/g$ or less.

In one embodiment of the fluidized bed reactor, the density and particle size of the refinery residue feedstock material, the catalyst, and/or that of the catalytically inert heat transfer solid, are selected such that the catalytically inert heat transfer solid remains within the emulsion phase of the fluidized bed, except for a small quantity that is lost as fines due to attrition between particles and reactor wall. The fines loss is kept at 10 wt % per day or less. The solid product of devolatilization of the solid refinery residue feedstock, the coke, on the other hand, ellutriates out of the reactor and is separated by cyclones from the rest of the process gas. In this embodiment of the fluidized bed reactor, the coke elutriating of the reactor is relatively free from catalytically inert heat transfer material (coke contains less than 1 wt % catalytically inert heat transfer material).

In step e), the gaseous hydrocarbons from step d) may be subjected to further processing to produce at least one of: C1-C3 hydrocarbons, liquefied petroleum gas, naphtha range hydrocarbons, and middle distillate range hydrocarbons. According to an embodiment, the further processing of step e) may consist of at least one of: condensation of gaseous hydrocarbon and distillation, hydroprocessing of condensed hydrocarbons in a hydroprocessing unit, and fluid catalytic cracking of condensed hydrocarbons in a fluid cracking unit.

According to the present invention, a significant amount of solid refinery residue feedstock is converted into high value products such as naphtha, kerosene and diesel while simultaneously producing a solid coke product which can be sold in the market as solid fuel or as anode grade coke.

Figure 3:
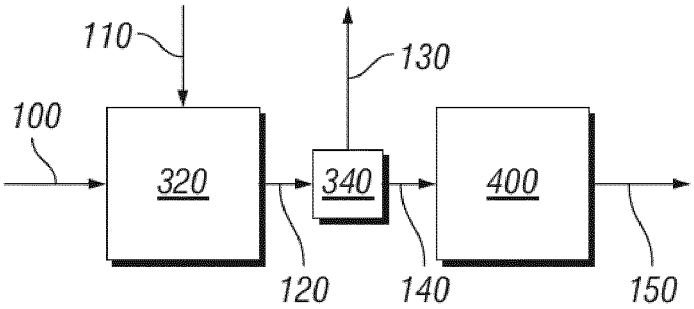
FIG. 3 shows an example process according to an embodiment of the disclosed subject matter.

Referring to FIG. 3, another implementation of the disclosed subject matter can be clearly understood. As shown in FIG. 3, a process for upgrading solid refinery residue feedstock may include step a) introducing the refinery residue feedstock (100) into a fluidized bed reactor (320) as a solid. A gaseous stream containing oxygen below the limiting oxygen concentration for combustion of solid refinery residue feedstock (110) may also be fed to the fluidized bed reactor (320). In step b), the refinery residue feedstock may be heated to a devolatilizing and thermal cracking temperature in the fluidized bed reactor to produce a product stream (120) comprising gaseous hydrocarbons and solid coke. For example, in the fluidized bed reactor (320) the refinery residue feedstock (100) may be subjected to heating, devolatilizing and thermal cracking to produce lighter hydrocarbons in an atmosphere containing an inert gas or a gas containing molecular hydrogen or hydrocarbon (110) and a catalyst. Further, the process may operate under conditions where the lighter hydrocarbons and other products of the thermal conversion process, except the coke co-product, remain in the gaseous phase. The product stream (120) comprising gaseous hydrocarbons and solid coke may be fed to separator (340). In step c), the gaseous hydrocarbons may be separated from the solid coke in separator (340) to produce a gaseous product stream (140) and a solid coke product stream (130). In step d), at least part of the gaseous hydrocarbons (140) from step c) may be contacted with an oxygen-containing gas (may be a stream fed to the incinerator (400) although not shown in FIG. 3) and combusted in incinerator (400) to generate energy. For example, the gaseous hydrocarbons (140) may be incinerated in an afterburner and the flue gas thereof may be used to produce steam (150) in a waste heat boiler.

According to another embodiment, a process for upgrading solid refinery residue feedstock may include the follow steps. First in step a) introducing the refinery residue feedstock into a fluidized bed reactor as a solid. Next, in step b), heating the refinery residue feedstock to a devolatilizing and thermal cracking temperature in the fluidized bed reactor to produce a product stream comprising gaseous hydrocarbons and solid coke. In step c), separating the gaseous hydrocarbons from the solid coke in step b) to produce a gaseous product stream and a solid coke product stream. In step d), combusting at least part of the gaseous hydrocarbons from step c) to generate energy.

In this embodiment, the vapor-phase product from the fluidized bed reactor, after separation from solid coke, may be incinerated in an afterburning system (afterburner) to produce hot flue gases which can be used to produce steam.

In this embodiment, the fluidized bed reactor in step b) may be a bubbling fluidized bed reactor comprising a catalytically inert heat transfer material fluidized in a stream of gas having an oxygen concentration below the minimum oxygen concentration needed to sustain combustion of the gaseous hydrocarbons or the solid coke in step b). The catalytically inert heat transfer solid may be a metal oxide material without any active metal, having a total surface area of 20 $m^2/g$ or less, and more preferably having a total surface area of 10 $m^2/g$ or less.

In another embodiment, the fluidized bed reactor in step b) may be an entrained fluidized bed reactor comprising the solid refinery residue feedstock and the solid coke entrained in a stream of gas having an oxygen concentration below the minimum oxygen concentration needed to sustain combustion of the gaseous hydrocarbon or the solid coke in the fluidized bed reactor in step b).

To facilitate a better understanding of the present invention, the following examples of specific embodiments are given. In no way should the following examples be read to limit, or to define, the scope of the invention.

EXAMPLES

Example 1—Determination of Volatile Material Content, Coke Content and Devolatilization Temperature of Asphalt Solid refinery residue samples, specifically, (1) an asphalt sample from a solvent deasphalting (SDA) unit which processes a feedstock of straight-run vacuum residue from a vacuum distillation unit, and (2) asphalt from an SDA unit which processes a feedstock of cracked residue from a visbreaker unit, were examined for volatile material content. This volatile material content represents the theoretically possible yield of gaseous hydrocarbons obtained by devolatilization and thermal processing of asphalt in the fluidized bed reactor according to the presently disclosed subject matter.

The results obtained from analyses of various asphalts are summarized in Table 1 below.

TABLE 1

| Property | Analysis Method | Unit of Measure | Asphalt sample-1 | Asphalt sample-2 | Asphalt sample-3 |
|---|---|---|---|---|---|
| Total Moisture Content | ASTM D4931 | % wt | 0 | 0 | 0 |
| Ash Content | ASTM D4422 | % wt | 0.14 | 0.22 | 0.19 |
| Volatile Material Content | ASTM D6374 | % wt | 63.54 | 68.09 | 58.95 |
| Fixed Carbon Content | By difference[1] | % wt | 36.32 | 31.69 | 40.86 |
| Sulfur Content | ASTM D1552 | % wt | 4.16 | 4.2 | 4.86 |
| Calorific Value (Gross) | ASTM D5865 | BTU/lb | 17107 | 17177 | 16683 |
| Nitrogen Content | ASTM D5373 | % wt | 0.98 | 1.06 | 1.14 |

TABLE 1-continued

| Property | Analysis Method | Unit of Measure | Asphalt sample-1 | Asphalt sample-2 | Asphalt sample-3 |
|---|---|---|---|---|---|
| Hydrogen Content | ASTM D5374 | % wt | 8.26 | 6.85 | 7.52 |

[1]Calculated as follows:
Fixed Carbon Content [% wt] = 100 − Total Moisture Content [% wt] − Ash Content [% wt] − Volatile Material Content [% wt]

Asphalt sample 1 was produced from vacuum residue as the feedstock at a 62% level of extraction of deasphalted oil (DAO) in a solvent deasphalting (SDA) unit.

Asphalt sample 2 was produced from vacuum residue as the feedstock at a 50% level of extraction of deasphalted oil (DAO) in a solvent deasphalting (SDA) unit.

Asphalt sample 3 was produced from vacuum residue as the feedstock at a 45% level of extraction of deasphalted oil (DAO) in a solvent deasphalting (SDA) unit.

As shown in Table 1, the amount of gaseous hydrocarbons that can be devolatilized from the asphalt exceeds 55 wt % for all three asphalt samples. This devolatilization is achieved by heating the asphalt and contacting the asphalt with a heated gaseous stream in the fluidized bed reactor according to the present invention.

The volatile material content analyses as provided in Table 1 above, was measured using ASTM D6374 analysis technique, demonstrates the expected extent of the formation of gaseous hydrocarbons from the asphalt sample when the asphalt is heated to about 1100° C. However, according to the present invention, it is possible to achieve devolatilization of asphalt to produce the gaseous hydrocarbons and coke at a lower temperature (about 450° C.), resulting in considerable simplification of the inventive process and the capital and operating cost of the process of this invention may be lowered significantly over the past industry processes operating at 1100° C.

Figure 4:
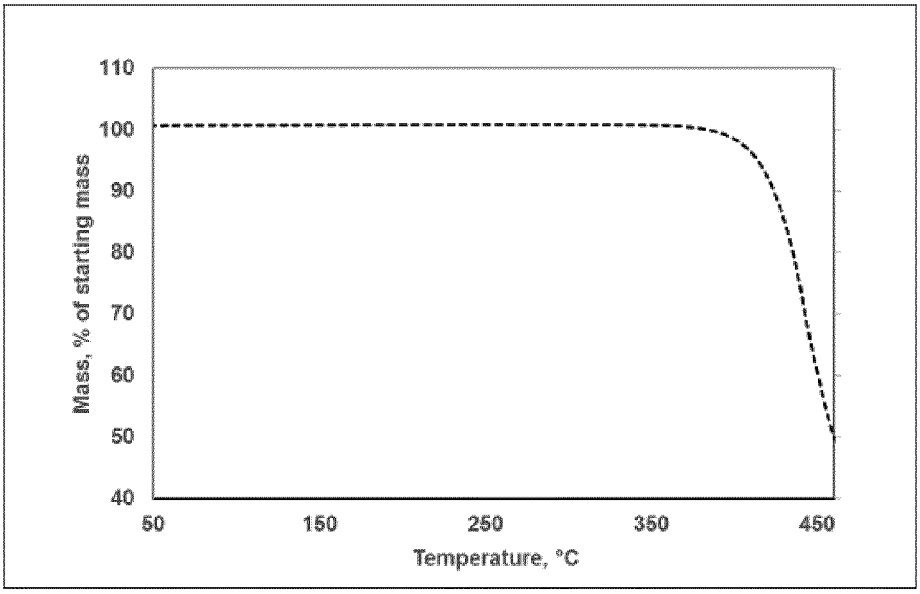
FIG. 4 provides a graph showing devolatilization of asphalt under flowing gas at various temperatures.

To demonstrate the operation of the fluidized bed reactor at a lower temperature, according to the process disclosed in the present invention, thermogravimetric analyses (TGA) of asphalt was carried out under flowing argon gas to strip away the gaseous hydrocarbons as they are produced. The thermogravimetric analysis was carried out at near ambient pressure with a ramp rate of 50° C./min. As shown in FIG. 4, TGA experiments demonstrate devolatilization of asphalt under flowing gas at temperatures as low as 450° C.-about 50 wt % of the asphalt was found to have devolatilized into a gaseous hydrocarbon at about 450° C. It should be noted that hydroprocessing catalysts typically operate at a temperature range of 300 and 500° C. Thus, the TGA experiments demonstrate the ability to carry out asphalt devolatilization and subsequent catalytic hydroprocessing in the same fluidized bed reactor, as disclosed according to an embodiment of the present invention.

Example 2—Introducing Asphalt Feedstock into a Bubbling Fluidized Bed Reactor as a Solid, and Achieving Catalyst-Asphalt Separation According to an embodiment of the present invention, a bubbling fluidized bed reactor contains a catalyst fluidized by a gaseous stream into which an asphalt feedstock is introduced as a solid. To allow for continuous operation of the bubbling fluidized bed, it must be possible to continuously introduce the asphalt feedstock into the reactor, while elutriating out reacted asphalt particles from the reactor continuously without elutriating out the catalyst particles. Only a small amount of catalyst fines, which may be generated due to collisions of the catalyst particles with solid surfaces in the system, may elutriate out (being of much lower mass and size than other catalyst particles in the reactor), however bulk carryover of catalyst particles must be avoided. The rate of loss of catalyst fines is generally less than 5 wt % of the catalyst inventory in the reactor per day.

As such, by carrying out cold flow studies of asphalt and catalyst, it has been demonstrated that the present invention achieves a desirable result. Cold flow studies comprise studying the operation of the fluidized bed reactor of according to the present invention using an experimental apparatus which mimics the hydrodynamics of the fluidized bed reactor of the present invention but operates at close to ambient temperature (about 25° C.) and at near ambient pressure.

The cold flow studies were carried out in a transparent acrylic reactor. The diameter of the section of the reactor containing the bubbling fluidized bed of catalyst was 1.75 in. (44.5 mm). The reactor was connected to a feed hopper through a screw feeder. The feed hopper was loaded with asphalt feedstock that was crushed and sieved to a desirable particle size range. A helical impeller mounted centrally in the feed hopper operated at ~10 RPM to prevent any bridging of the asphalt feedstock. A screw feeder at the bottom of the feed hopper introduced the feedstock into the reactor at a controlled rate. Commercially available hydroprocessing catalyst S-4291 (from Shell Catalysts and Technologies) was crushed and sieved to desirable particle size range and used without any further processing.

It was found that the asphalt feedstock prepared by crushing and sieving to the size range shown in Table 2 below could be introduced into a bubbling fluidized bed of catalyst at a controlled rate using a screw feeder.

As mentioned above, the separation between the catalyst and the solid residue feedstock is necessary to allow for a continuous operation of the process. The variables that impact this separation are: asphalt particle size range, catalyst particle size range, fluidization velocity, and the density of gas used. Experiments were conducted with varying feedstock and catalyst particle size range. Table 2 below presents the results of three such experiments. Separation of asphalt from the catalyst was determined visually—it is indicated by continuous carryover of asphalt out of the reactor and its accumulation in a collection vessel downstream of the reactor. Separation was achieved in two of the three experiments under conditions mentioned below (specifically Run-1 and Run-3). Asphalt was continuously introduced into the reactor from the bottom and elutriated from the top of the reactor without any elutriation of the catalyst loaded. In another experiment, separation could not be achieved, and asphalt feedstock entering the reactor from the bottom continued to build-up in the reactor (specifically Run-2).

TABLE 2

| Parameter | Unit of Measure | Run-1 | Run-2 | Run-3 |
|---|---|---|---|---|
| Catalyst used | — | S-4291 | S-4291 | S-4291 |
| Catalyst Diameter (min) | mm | 1.5 | 0.5 | 0.5 |
| Catalyst Diameter (max) | mm | 1.7 | 0.7 | 0.7 |
| Compacted bulk density of catalyst | g/mL | 0.67 | 0.67 | 0.67 |
| Asphalt feed size range (min to max) | mm | 0.25 to 0.5 | 0.25 to 0.5 | 0 to 0.25 |
| Compacted bulk density of asphalt | g/mL | 0.57 | 0.57 | 0.57 |
| Reactor diameter | in | 1.75 | 1.75 | 1.75 |
| Unexpanded height of catalyst bed | cm | 36 | 31 | 21 |
| Mean bed height after fluidization | cm | ~70 | ~130 | ~100 |
| Fluidization velocity | m/s | 0.81 | 1.02 | 0.54 |
| Catalyst-asphalt separation achieved? | | Yes | No | Yes |

Example 3—Conversion of Asphalt into Hydrocarbons and Coke

Asphalt was upgraded into high quality hydrocarbons and coke in a two-reactor system, containing a fluidized bed reactor (also referred to as the 1$^{st}$ stage reactor or 1$^{st}$ reactor i.e. item (32) in FIG. 2) in series with a fixed bed reactor (also referred to as the 2$^{nd}$ stage reactor, or 2$^{nd}$ reactor i.e. item (36) in FIG. 2). Between the two reactors, a hot gas filter was provided. The hot gas filter separates any solids elutriated out of the fluidized bed reactor such as coke and catalyst fines.

RN-8510 catalyst (a residue upgrading catalyst commercially available from Shell Catalysts & Technologies) was ground and sieved to a particle size range of 500 μm to 700 μm. 250 g of this crushed catalyst was provided as the 1$^{st}$ upgrading catalyst in a bubbling fluidized bed reactor. DN-3552 catalyst (a distillate hydrotreating catalyst commercially available from Shell Catalysts & Technologies) was dried to remove any traces of hydrocarbons. 2.0 kg of the dried catalyst, in the form of extrudates of 1.3 mm diameter and approximately 3 mm to 6 mm length, was used as the 2$^{nd}$ upgrading catalyst in the second, fixed bed reactor.

To introduce asphalt into the fluidized bed reactor by a screw feeder system, it was ground to a particle size of <250 μm. To avoid agglomeration of the ground asphalt in the screw feeder or at the bottom of the fluidized bed reactor, it was diluted by mixing it with an inert, carbon-rich solid that does not melt. The carbon rich solid was biochar produced by subjecting a lignocellulosic biomass (in this case, sawdust of Pine) to elevated temperatures (between 450 and 500° C.). The biochar used was ground to the same size as asphalt, <250 μm. The two solids were mixed in a metal beaker containing an overhead stirrer rotating at about 70 RPM at a temperature of about 180° C. in a ratio of 30 wt % asphalt and 70 wt % biochar. The resulting mixed solid remained free flowing at 180° C. without formation of any agglomerates. When asphalt alone is ground to <250 μm particle size and heated to 180° C., it agglomerates and does not remain free flowing. Thus, use of an inert diluent helps in retaining the free-flowing nature of asphalt even at elevated temperatures (150-200° C.) which are encountered as the asphalt flows through the screw feeder and into the reactor.

Any suitable inert solid may be used as a diluent. For example, coke produced as a by-product of asphalt conversion may itself be recycled back to the reactor as diluent. Alternate means of introducing asphalt which avoid agglomeration of asphalt in the feeder or reactor bottom may be used as well. For example, atomization nozzles that generate small droplets of asphalt may be used to introduce asphalt into the fluidized bed reactor. The droplets may be carried away by the hot fluidization gas and converted into hydrocarbons and coke before they coalesce into larger droplets.

The catalyst in the 1$^{st}$ bubbling fluidized reactor was fluidized with a stream of hydrogen pre-heated to a temperature of approximately 474° C. After the 1$^{st}$ stage catalyst had been fluidized, the asphalt feedstock was introduced into the reactor using a screw feeder and processed in a continuous manner. The average rate of processing of mixed asphalt-biochar feedstock was maintained at 405.6 g/hour, corresponding to a weight hourly space velocity (WHSV) of the asphalt feedstock to the 1$^{st}$ stage reactor of approximately 0.49 kg asphalt per kg catalyst per hour. The weighted average temperature of the fluidized bed of catalyst was 462° C. over the duration of asphalt processing. The asphalt feedstock was converted to a mixture of coke and hydrocarbon vapours in the 1$^{st}$ stage reactor. The fluidization velocity was adjusted in such a way that the solid products (coke and biochar) and the vapour phase products were carried out of the reactor, while the catalyst remained in the reactor. This desirable outcome could be achieved at superficial gas velocity of 0.30 m/s. Some catalyst was attrited into fines, and the fines were carried out of the bed as well.

The solid product was separated from the vapour phase product in the hot gas filter and the vapours were sent to the 2$^{nd}$ stage, fixed bed reactor. The average temperature of the 2$^{nd}$ stage catalyst was maintained at 332° C. The average WHSV to the 2$^{nd}$ stage was 0.061 kg asphalt per kg catalyst per hour. Total operating pressure for both 1$^{st}$ and 2$^{nd}$ stages was 21.96 barg.

The vapour phase product of 2$^{nd}$ stage reactor was cooled in stages to −55° C. and a liquid hydrocarbon product was recovered and analysed. The off gas from the process was collected in sample cylinders and analysed using a gas chromatograph (GC) for its composition. The mass balance and carbon balance of the process was calculated from the mass and analysis of the liquid products and compositional information of the gas product, based on which the yield profile was calculated.

The operating conditions for the two reactors and the yield of various types of products is mentioned in the Table 3 below.

TABLE 3

| Parameter | Unit of Measure | Result |
|---|---|---|
| Feedstock | — | 30 wt % asphalt, 70 wt % inert biochar |
| First Stage Catalyst | — | RN-8510 |
| Second Stage Catalyst | | DN-3552 |
| 1$^{st}$ Stage Weighted-Average Bed Temperature (WABT) | ° C. | 462 |
| 2$^{nd}$ Stage WABT | ° C. | 332 |
| Fluidization Velocity | m/s | 0.30 |
| Pressure | bara | 22.0 |
| $C_4^+$ Hydrocarbon yield (Hydrocarbons with 4 and more carbon atoms) | wt % on asphalt | 35.2 |
| $C_2$-$C_3$ Hydrocarbon Yield | wt % on asphalt | 7.4 |
| Coke yield | wt % on asphalt | 54.2 |

Figure 5:
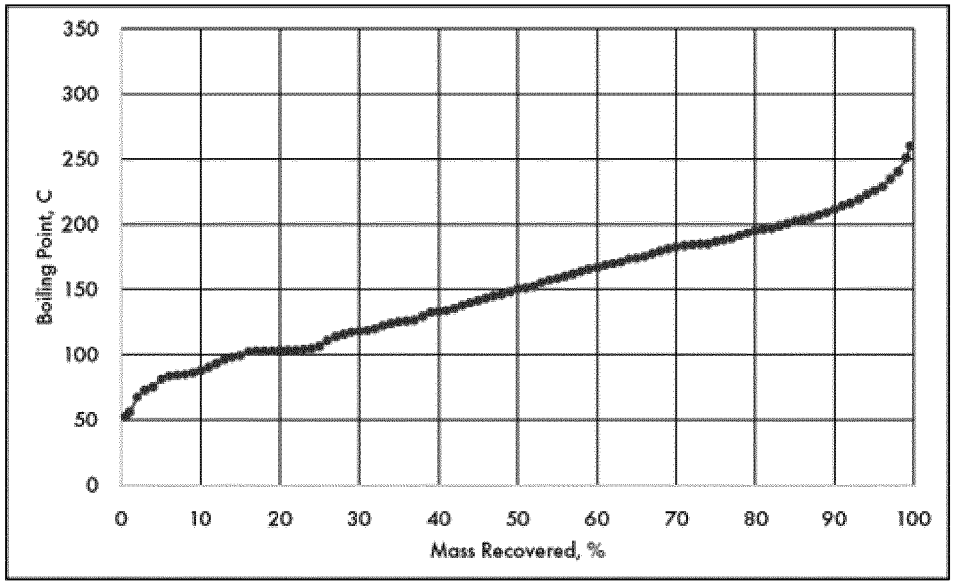

The hydrocarbon liquid produced was found desirably to be boiling in the naphtha and kerosene range with final boiling point<275° C. as measured using ASTM D2887 simulated distillation. Boiling range distribution of the hydrocarbon liquid as measured using ASTM D2887 method is shown in FIG. 5.

The elemental composition and density of the hydrocarbon liquid produced is presented in the Table 4 below. As seen in this table, the heteroatom content of the liquid was extremely low compared to any previously known method that may use asphalt as the feedstock, which may typically contain 5-7 wt. % sulphur-sulfur content was now only 13.7 ppm by weight, while nitrogen content was now only 1.1 ppm by weight. Hydrogen content was quite high at 14.35 wt %, indicating hydroprocessing reactions producing high quality hydrocarbon are taking place under the moderate conditions of pressure used here, as compared to conventional processes that process 'bottom of barrel' feedstock typically much higher pressures, such as, higher than 100 barg.

TABLE 4

| Parameter | Unit of Measure | Result |
|---|---|---|
| Carbon content | wt % | 85.53 |
| Hydrogen content | wt % | 14.35 |
| Sulfur content | ppmw | 13.7 |
| Nitrogen content | ppmw | 1.1 |
| Density at 15° C. | g/mL | 0.7670 |

Example 4—Conversion of Asphalt into Hydrocarbons and Coke

The same experimental set-up as used in Example 3 was used.

RN-8510 catalyst (a residue upgrading catalyst commercially available from Shell Catalysts & Technologies) was ground and sieved to a particle size range of 500 μm to 700 μm. 250 g of this crushed catalyst was provided as the $1^{st}$ upgrading catalyst in a bubbling fluidized bed reactor. DN-3552 catalyst (a distillate hydrotreating catalyst commercially available from Shell Catalysts & Technologies) was dried to remove any traces of hydrocarbons. 2.0 kg of the dried catalyst, in the form of extrudates of 1.3 mm diameter and approximately 3 mm to 6 mm length, was used as the $2^{nd}$ upgrading catalyst in the second, fixed bed reactor.

To introduce asphalt into the fluidized bed reactor by a screw feeder system, it was ground to a particle size of <250 μm. To avoid agglomeration of the ground asphalt in the screw feeder or at the bottom of the fluidized bed reactor, it was diluted by mixing it with an inert, carbon-rich solid that does not melt. The carbon rich solid was biochar produced by subjecting a lignocellulosic biomass (in this case, sawdust of Pine) to elevated temperatures (between 450 and 500° C.). The biochar used was ground to the same size as asphalt, <250 μm. The two solids were mixed in a metal beaker containing an overhead stirrer rotating at about 70 RPM at a temperature of about 180° C. in a ratio of 30 wt % asphalt and 70 wt % biochar. The resulting mixed solid remained free flowing at 180° C. without formation of any agglomerates. When asphalt alone is ground to <250 μm particle size and heated to 180° C., it agglomerates and does not remain free flowing. Thus, use of an inert diluent helps in retaining the free-flowing nature of asphalt even at elevated temperatures (150-200° C.) which are encountered as the asphalt flows through the screw feeder and into the reactor.

It should be noted here that any suitable inert solid may be used as a diluent. For example, coke produced as a by-product of asphalt conversion may itself be recycled back to the reactor as diluent. Alternate means of introducing asphalt which avoid agglomeration of asphalt in the feeder or reactor bottom may be used as well. For example, atomization nozzles that generate small droplets of asphalt may be used to introduce asphalt into the fluidized bed reactor. The droplets may be carried away by the hot fluidization gas and converted into hydrocarbons and coke before they coalesce into larger droplets.

The catalyst in the $1^{st}$ bubbling fluidized reactor was fluidized with a stream of hydrogen pre-heated to a temperature of approximately 496° C. After the $1^{st}$ stage catalyst had been fluidized, the asphalt feedstock was introduced into the reactor using a screw feeder and processed in a continuous manner. The average rate of processing of mixed asphalt-biochar feedstock was maintained at 481.3 g/hour, corresponding to a weight hourly space velocity (WHSV) of the asphalt feedstock to the $1^{st}$ stage reactor of approximately 0.58 kg asphalt per kg catalyst per hour. The weighted average temperature of the fluidized bed of catalyst was 467° C. over the duration of asphalt processing. The asphalt feedstock was converted to a mixture of coke and hydrocarbon vapours in the $1^{st}$ stage reactor. The fluidization velocity was adjusted in such a way that the solid products (coke and biochar) and the vapour phase products were carried out of the reactor, while the catalyst remained in the reactor. This desirable outcome could be achieved at superficial gas velocity of 0.30 m/s. Some catalyst was attrited into fines, and the fines were carried out of the bed as well.

The solid product was separated from the vapour phase product in the hot gas filter and the vapours were sent to the $2^{nd}$ stage, fixed bed reactor. The average temperature of the $2^{nd}$ stage catalyst was maintained at 302° C., lower than in Experiment 3. The average WHSV to the $2^{nd}$ stage was 0.072 kg asphalt per kg catalyst per hour. Total operating pressure for both $1^{st}$ and $2^{nd}$ stages was 21.68 barg.

The vapour phase product of $2^{nd}$ stage reactor was cooled in stages to −55° C. and a liquid hydrocarbon product was recovered and analysed. The off gas from the process was collected in sample cylinders and analysed using a gas chromatograph (GC) for its composition. The mass balance and carbon balance of the process was calculated from the mass and analysis of the liquid products and compositional information of the gas product, based on which the yield profile was calculated.

The operating conditions for the two reactors and the yield of various types of products is mentioned in the Table 5 below.

TABLE 5

| Parameter | Unit of Measure | Result |
|---|---|---|
| Feedstock | — | 30 wt % asphalt, 70 wt % inert biochar |
| First Stage Catalyst | — | RN-8510 |
| Second Stage Catalyst | | DN-3552 |
| $1^{st}$ Stage Weighted-Average Bed Temperature (WABT) | ° C. | 467 |

TABLE 5-continued

| Parameter | Unit of Measure | Result |
|---|---|---|
| $2^{nd}$ Stage WABT | ° C. | 302 |
| Fluidization Velocity | m/s | 0.30 |
| Pressure | bara | 21.7 |
| $C_4^+$ Hydrocarbon yield (Hydrocarbons with 4 and more carbon atoms) | wt % on asphalt | 45.5 |
| $C_2$-$C_3$ Hydrocarbon Yield | wt % on asphalt | 7.3 |
| Coke yield | wt % on asphalt | 51.5 |

Figure 6:
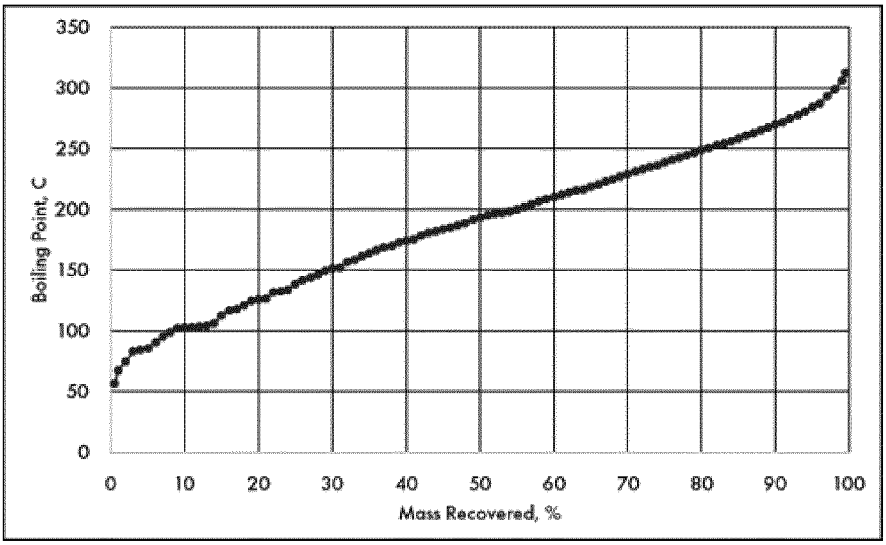

The hydrocarbon liquid produced was found to be desirably boiling in the naphtha, kerosene and diesel range with final boiling point<325° C. as measured using ASTM D2887 simulated distillation. Boiling range distribution of the hydrocarbon liquid as measured using ASTM D2887 method is shown in FIG. 6.

The elemental composition and density of the hydrocarbon liquid produced is presented in the Table 6 below. As seen in this table, the heteroatom content of the liquid remains extremely low-sulfur content was only 2.5 ppm by weight, while nitrogen content was only 0.7 ppm by weight. Hydrogen content remains high at 14.07 wt %, indicating hydroprocessing reactions producing high quality hydrocarbon are taking place under the moderate conditions of pressure used here, as compared to conventional processes that process 'bottom of barrel' feedstock typically much higher pressures, such as, higher than 100 barg.

TABLE 6

| Parameter | Unit of Measure | Result |
|---|---|---|
| Carbon content | wt % | 85.86 |
| Hydrogen content | wt % | 14.07 |
| Sulfur content | ppmw | 2.5 |
| Nitrogen content | ppmw | 0.7 |
| Density at 15° C. | g/mL | 0.8000 |

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A process for upgrading refinery residue feedstock, said process comprising the steps of:

a) introducing the refinery residue feedstock into a fluidized bed reactor as a solid;

b) heating the refinery residue feedstock to a devolatilizing and thermal cracking temperature in the fluidized bed reactor to produce a product stream consisting of gaseous hydrocarbons and solid coke;

c) subjecting the gaseous hydrocarbons to catalytic hydroprocessing in the presence of molecular hydrogen in the fluidized bed to increase the hydrogen to carbon ratio and lower the average molecular weight of the gaseous hydrocarbons;

d) separating the gaseous hydrocarbons from step c) from the solid coke from step b) to produce a gaseous product stream and a solid coke product stream; and e) subjecting the gaseous hydrocarbons from step d) to further processing to produce at least one of: C1-C3 hydrocarbons, liquefied petroleum gas, naphtha range hydrocarbons, and middle distillate range hydrocarbons.

2. The process of claim 1, wherein the fluidized bed reactor in step b) is a bubbling fluidized bed reactor.

3. The process of claim 2, wherein the weight-hourly space velocity of the refinery residue feedstock is from 0.05 to 25 kilograms of feedstock per kilogram of catalyst per hour in the bubbling fluidized bed.

4. The process of claim 2, wherein the fluidized bed reactor comprises at least one catalyst comprising at least one active metal selected from the group consisting of: group VB, group VIB and group VIII of the periodic table supported on metal oxide selected from: alumina, silica, titania, silica-alumina, ceria, zirconia, crystalline aluminosilicates and combinations thereof.

5. The process of claim 1, wherein the fluidized bed reactor in step b) is a bubbling fluidized bed reactor comprising a catalytically inert heat transfer material.

6. The process of claim 5, wherein the catalytically inert heat transfer solid is a metal oxide material without any active metal, having a total surface area of 20 $m^2/g$ or less.

7. The process of claim 1, wherein the fluidized bed reactor in step b) is an entrained fluidized bed reactor, whereby the solid refinery residue feedstock and the solid coke are entrained in a stream of gas containing molecular hydrogen.

8. The process of claim 1, wherein the fluidized bed reactor of step a) operates at a total pressure of from 2 barg to 100 barg and the devolatilizing temperature in step b) is from 300° C. to 600° C.

9. The process of claim 1, wherein the further processing of step e) consists of at least one of:

condensation of gaseous hydrocarbon and distillation, hydroprocessing of condensed hydrocarbons in a hydroprocessing unit, and fluid catalytic cracking of condensed hydrocarbons in a fluid cracking unit.

* * * * *